United States Patent [19]

Osberghaüs et al.

[11] Patent Number: 4,603,450

[45] Date of Patent: Aug. 5, 1986

[54] FRAME FOR A FLOOR WIPER

[75] Inventors: Rainer Osberghaüs, Duesseldorf; Bernfrid Scheller, Pulheim; Roland Schunter, Lorch-Waldhausen; Franz Kresse, Hilden; Helmut Schell, Monheim, all of Fed. Rep. of Germany

[73] Assignee: Henkel Kommanditgesellschaft auf Aktien, Duesseldorf, Fed. Rep. of Germany

[21] Appl. No.: 690,787

[22] Filed: Jan. 11, 1985

[30] Foreign Application Priority Data

Jan. 12, 1984 [DE] Fed. Rep. of Germany ..... 3400871
Mar. 30, 1984 [DE] Fed. Rep. of Germany ..... 3411858

[51] Int. Cl.[4] ..... A47L 13/258
[52] U.S. Cl. ..... 15/147 A; 15/228
[58] Field of Search ..... 15/147 R, 147 C, 150, 15/229 AP, 229 BP, 147 AB, 228, 229 AC, 229 BC

[56] References Cited

U.S. PATENT DOCUMENTS 2,987,745 6/1961 Ballinger ..... 15/229 BP
3,085,271 4/1963 Janssen ..... 15/229 BP X
3,447,182 6/1967 Shinagawa ..... 15/147

FOREIGN PATENT DOCUMENTS 2720622 11/1978 Fed. Rep. of Germany .
2914230 10/1980 Fed. Rep. of Germany .
3137791 6/1982 Fed. Rep. of Germany .

*Primary Examiner*—Chris K. Moore
*Attorney, Agent, or Firm*—Ernest G. Szoke; Henry E. Millson, Jr.; Mark A. Greenfield

[57] ABSTRACT

An improved frame for a floor wiper consisting of two frame members (1,2) designed to fold towards on another about a pivot pin (3) and to be locked in their fully extended or open position by means of a locking mechanism (4,5) is simplified in its construction and can be made with a minimum of material and component parts providing one frame member (1) has a T-shape and the other frame members (2) a U-shape which makes with the T a substantially rectangular plate and providing the pivot pin (3) extends substantially perpendicularly of the longitudinal axis of the T and U arms (10,15) and providing the locking mechanism contains a permanent-magnet clamp (4,5). To reduce the volume and weight of the permanent magnet (4), the force arm (K) on which the magnetic force acts is intended to be as long as possible.

13 Claims, 3 Drawing Figures

FIG. 2
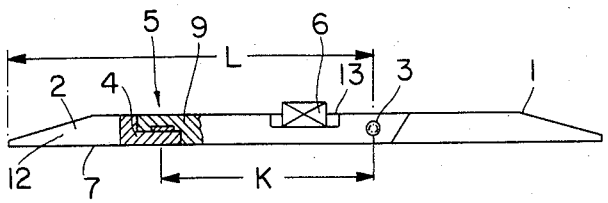
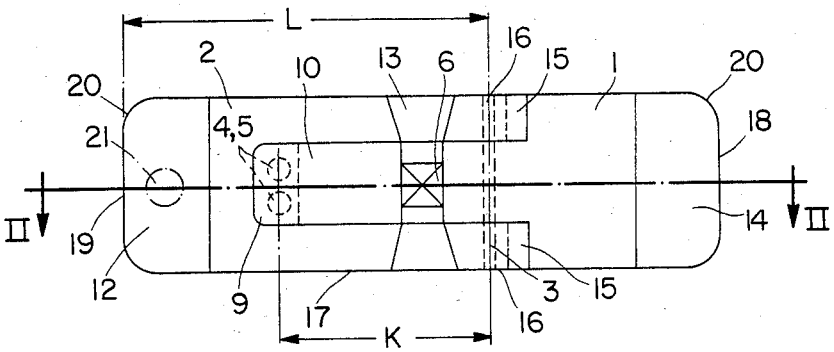
FIG. 1
FIG. 3
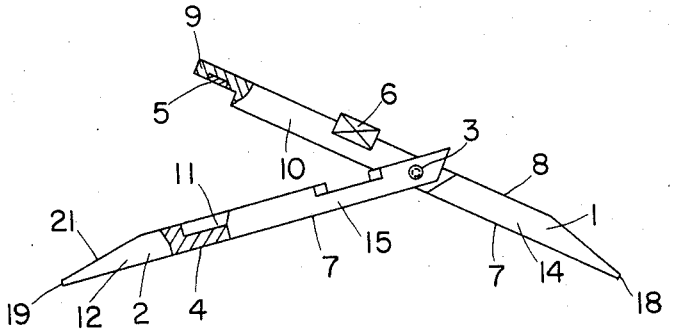

FRAME FOR A FLOOR WIPER

BACKGROUND OF THE INVENTION

This invention relates to an improvement in a frame for a floor wiper comprising a flat frame which is equipped with a handle socket preferably attached by a universal joint and which is designed to be introduced at its longitudinal ends into the end pockets of a replaceable mop, consisting of two frame members foldable towards one another about a pivot pin extending substantially parallel to the bottom surface of the flat frame and lockable in the fully extended or open position by a locking mechanism.

In the frame of a floor wiper described in DE-OS No. 29 14 230, the locking mechanism consists of an arm of the second frame member designed to pivot into a slot in the first frame member in the fully extended or open position of the wiper and of a locking tongue pivotally mounted on the first frame member and designed to be pushed between the first frame member and the arm. In this known wiper frame, locking and unlocking can be carried out by actuating the locking mechanism. The locking mechanism is foot-operated so that the replaceable mop does not have to be touched by hand on removal from the frame. However since the foot-operated lock can only be released when the wiper is resting on the floor, some difficulty is involved in throwing a used mop into a refuse bin after the mop frame has been unlocked.

Accordingly, the mop frame described in DE-OS No. 31 37 791 was developed. This mop frame consists of two frame members attached to a support plate, one of which is lockably mounted on the support plate about a pin extending transversely of the longitudinal axis of the frame. In this case, locking is obtained by turning the handle which is universally mounted on a bearing shaft secured in two bearings on the support plate and extending substantially parallel to the longitudinal axis. A bracket coupled with the bearing shaft is provided for that purpose, surrounding one arm of the frame member to be folded in the range over which the handle is designed to be rotated in use. In this known floop wiper, therefore, the mop cannot be accidentally unlocked with normal handling. However, manufacture of the floor wiper requires a number of component parts which are difficult to assemble and all of which are generally made of stainless refined steel to counteract premature corrosion.

OBJECTS OF THE INVENTION

An object of the present invention is to provide a folding floor wiper frame for replaceable mops in which replacement of the mops and also locking and unlocking can be carried out without any need for manual contact and of which the construction is extremely simple and, despite its ability to withstand even the roughest working conditions, requires a minimum of material and parts. More particularly, it is intended to be able to produce the wiper essentially from plastic parts, preferably with a flat underneath and/or upper surface. In the frame for a floor wiper comprising two frame members designed to be folded towards one another about a pivot pin and to be locked in their open position by means of a locking mechanism, this object is achieved in that one frame member has a T-shape and the other frame member a U-shape which makes with the T-shaped member into a substantially rectangular plate and in that pivot pin extends substantially perpendicularly of the longitudinal direction of the arms of the T and the U and in that the locking mechanism contains a permanent magnet clamp.

Another object of the present invention is an improvement in a frame for a floor wiper comprising a flat frame shape equipped with a handle socket, which frame is designed to be introduced at its longitudinal ends into the end pockets of a replaceable mop, consisting of two frame members foldable towards one another about a pivot pin extending substantially parallel to the bottom surface of said flat frame shape and lockable in the fully extended or open position by a lock means, the improvement consisting essentially in that one of the two frame members has a T-shape and the other frame member has a U-shape, said T-shape and said U-shape adapted to form a substantially rectangular plate flat frame shape, said pivot pin extending substantially perpendicularly to the longitudinal direction of the arms of the T-shape and the U-shape of said two frame members, and said lock means comprises a permanent magnet and counter-plate forming a permanent magnet clamp.

These and other objects of the invention will become more apparent as the description thereof proceeds.

DESCRIPTION OF THE INVENTION

The frame for a floor wiper according to the invention preferably consists essentially of a T-shaped frrame member which is designed to be attached to the handle socket; a U-shaped frame member; a pivot pin, preferably of stainless steel which joins the two frame members, more particularly of plastic, together; a permanent magnet with counter-plate which holds the two frame members together in their fully extended or open position. The shaping of the frame members ensures that the wiper may be made mostly of plastic.

More particularly, the present invention relates to an improvement in a frame for a floor wiper comprising a flat frame shape equipped with a handle socket, which frame is designed to be introduced at its longitudinal ends into the end pockets of a replaceable mop, consisting of two frame members foldable towards one another about a pivot pin extending substantially parallel to the bottom surface of said flat frame shape and lockable in the fully extended or open position by a lock means, the improvement consisting essentially in that one of the two frame members has a T-shape and the other frame member has a U-shape, said T-shape and said U-shape adapted to form a substantially rectangular plate flat frame shape, said pivot pin extending substantially perpendicularly to the longitudinal direction of the arms of the T-shape and the U-shape of said two frame members, and said lock means comprises a permanent magnet and counter-plate forming a permanent magnet clamp.

The frame for a floor wiper according to the invention involves far less outlay in material and assembly work and, in addition, affords the opportunity of designing the frame members in such a way that, in the fully extended or open position, they are substantially flat and uninterrupted, above all over their bottom surface. For this simple reason, even the handling of the wiper in use affords significant advantages over known wipers with bracket-like frame members.

Particular attention is to be paid to the design of the permanent-magnet clamp. This is because the magnetic locking force of the locking mechanism is not determined solely by the magnet or magnet system used, but also by the material to be attracted and the position of the particular magnet relative to the pivoting axis of the wiper frame as a whole. Thus, in the present context, the holding power of magnets, aside from the material used, magnetization, pole interval, dimensions etc., is also determined for the most part by the mass and hence by the weight of the magnet itself.

So far as the use of magnets in the locking mechanism of a folding floor wiper is concerned, it is important to keep the weight and size of the magnets used for locking to a minimum and optimally to utilize the magnetization present in the magnetic mass for firm locking, taking (mechanical) leverage laws into account. Since, in the case of a lever, the product of force times force arm is equal to the product of load times load arm and since the latter product is predetermined by half the weight of the mop and the weight of the load arm, the mass of the magnet used may be kept below any particular value required providing the magnet is attached to the free end of as long a force arm as possible. If the ratio of force arm to load arm is 1:2 for example, a magnetic holding force of 2 kg is sufficient to establish an equilibrium where the frame and mop weighs 1 kg and the load arm weighs 0.5 kg. In such a case, if the magnet used is a flat gripping magnet having a holding force of 3 kg, much greater magnetic forces are available to compensate the pulling and pushing forces acting on the lock in the operation of the mop.

Where magnetic clamps are used as the locking mechanism in a frame for a floor wiper according to the invention, it is also important to ensure that magnetic short circuits are avoided. Accordingly, all parts adjoining the locking magnet and/or its counter-plate must consist of non-magnetizable material, for example chrome-nickel steel, plastic or the like. Thus, where the frame members of the floor wiper are made of plastic and where a steel pin is used, arrangement of the magnetic lock in the zone adjoining one of the longitudinal ends of the frame is preferred not only because of the more favorable leverage, but also because of the greater distance from the pin.

Particulars of the invention are described in the following with reference to one example of embodiment illustrated in the accompanying diagrammatic drawings, wherein:

FIG. 1 is a plan view of the top of a frame for a floor wiper.

FIG. 2 is a section on the line II—II in FIG. 1.

FIG.3 is an elevation in the direction of the pivot pin of the frame for a floor wiper shown in FIG. 1 in its folded position.

The frame for a floor wiper shown in FIGS. 1 to 3 consists of a T-shaped frame member globally denoted by the reference 1, a U-shaped frame member globally denoted by the reference 2, a pivot pin 3 joining the two frame members 1 and 2 together, a permanent magnet 4 with counter-plate 5 which can be inserted into the frame members 1 and 2 and lock the wiper in its fully extended or open position; and finally of a handle socket 6 symbolized in the drawing.

The two frame members 1 and 2 which are preferably made of a plastic resistant to the usual cleaners are shaped in such a way that they fit into one another and, in the fully extended or open position, together form a substantially flat rectangular surface. In practice, the frame members 1 and 2 may be cut out for example from a 14 mm thick plastic panel in such a way that, together, they cover an area being 85 mm parallel to the pivot pin 3 and 560 mm perpendicularly of the pivot pin 3.

The locking mechanism by which the frame members are locked in the fully extended or open position is designed in such a way that it does not project beyond the bottom surface 7, nor—preferably—beyond the upper surface 8 of the wiper. In the embodiment illustrated, this is achieved by a notched or shoulder end section 9 of the T arm 10 of the frame member 1 and a groove-like recess 11 adapted to the shape of the end sectiom 9 in the region of the crossbar 12 of the U-shaped frame member 2 when the counter-plate 5 and the permanent magnet 4 are let into the surfaces of the end section 9 and the recess 11 which lie on top of one another in the open position.

To be able to integrate the permanent magnet 4 and the counter-plate 5 in the above-mentioned manner in the body of the T arm 10 and of the U-shaped frame member 2, the space occupied by the permanent magnet and the counter plate has to be kept to a certain maximum. However, this does of course also restrict the magnetic force available. For this reson, the force arm K on which the magnetic force acts is made as large as possible so that the ratio to the load arm L is correspondingly favorable. In the drawing, the ratio of K to L is about 1:2. This means that the holding force of the magnet 4 has to be twice as great as the entire load to establish an equilibrium. In the practical application of the floor wiper, therefore, a holding force of at least twice the weight of the mop will be necessary if the lock is to provide adequate resistance to the pushing and pulling forces applied in practice.

A universal handle socket 6 is arranged in the middle of the upper surface 8 of the floor wiper. In the embodiment illustrated, there is a conically tapering slot on both sides. This slot is used to accommodate the handle socket 6 during production, for example by molding, of the frame members. Between the attachment of the handle socket 6 and the crossbar 14 of the T-shaped frame member 1, the pivot pin 3 passes through the two U arms 15 of the frame member 2 and the T arm 10 of the frame member 1 situated in between. The longitudinal ends 16 of the pivot pin 3 are designed to be recessed from the outer longitudinal edges 17 of the U arms 15 to avoid entanglement with the mop.

When the wiper is in use, the mop comprising end pockets (not shown) is placed flat on the floor. In this position, the wiper can be introduced at its longitudinal ends 18 and 19 into the pockets in the folded position shown in FIG. 3. By applying pressure to the handle secured to the handle socket 6, the longitudinal ends 18 and 19 are introduced into the mop pockets. This operation is made easier by using frame members 1 and 2 having rounded outer corners 20. Preferably, these longitudinal ends are tapered at their ends.

By pivoting the frame members 1 and 2 so that they come together and form a flat frame, the mop adapted in its length to the common length of the frame members 1 and 2 (or vice versa) is placed under tension. In this fully extended or open position, the frame members 1 and 2 are locked by the magnet 4 and counter-plate 5. The wiper may now be used in the proper way.

To unlock the wiper, it is sufficient to apply impact or pressure to the zone 21 on the upper surface of the frame member 2 if the entire wiper is depending from the handle in space or, if the frame is lying flat on the ground, to apply pressure, for example by foot, to the zone 21 while at the same time pulling up the handle and the handle socket 6.

In another embodiment of the frame members, both the T-shaped frame member and the U-shaped frame member can be made of wire frames. In this connection, the caution given above with respect to avoiding magnetic short circuit must be observed.

The preceding is a non-limiting embodiment of the frame for a floor wiper of the invention. It is to be understood, however, that other expedients known to those skilled in the art or disclosed herein may be employed without departing from the spirit of the invention or the scope of the appended claims.

REFERENCE NUMBERS INDEX

1=T-shaped frame member
2=U-shaped frame member
3=Pivot pin
4=Permanent magnet
5=Counter-plate
6=Handle socket
7=Bottom surface
8=Upper surface
9=Tapering end section end cut
10=T arm
11=Groove-like recess
12=U cross bar
13=Nut
14=T cross bar
15=U arms
16=Longitudinal ends
17=Outer longitudinal edges
18=Mop longitudinal ends
19=Mop longitudinal ends
20=Rounded outer corners
21=Pressure zone
K=Force arm
L=Load arm

We claim:

1. In a frame for a floor wiper comprising a flat frame shape equipped with a handle socket, which frame is designed to be introduced at its longitudinal ends into the end pockets of a replaceable mop, consisting of two frame members foldable towards one another about a pivot pin extending substantially parallel to the bottom surface of said flat frame shape and lockable in the fully extended or open position by a lock means, the improvement consisting essentially in that one of the two frame members has a T-shape and the other frame member has a U-shape, said T-shape and said U-shape adapted to form a substantially rectangular plate flat frame shape, said pivot pin extending substantialy perpendicularly to the longitudinal direction of the arms of the T-shape and the U-shape of said two frame members, and said lock means comprises a permanent magnet and counter-plate forming a permanent magnet clamp.

2. The frame for a floor wiper of claim 1, wherein said handle socket comprises a universal joint attached substantially in the middle of said flat frame shape.

3. The frame for a floor wiper of claim 1, wherein said handle socket comprises a universal joint attached to the arm of said T-shaped frame member surrounded by the U-shaped frame member substantially in the middle of the rectangle formed by said two frame members.

4. The frame for a floor wiper of claim 3, wherein the frame formed by said two frame members contains a groove substantially in the middle of its upper side extending to both longitudinal edges adapted for insertion of said handle socket.

5. The frame for a floor wiper of claim 1, wherein said pivot pin extends through the arms of the T-shape and the U-shape of said two frame members in the area between said handle socket and the crossbar of said T-shaped frame member.

6. The frame for a floor wiper of claim 1, wherein the free end of the arm of said T-shaped frame member is adapted to contain one of said permanent magnet or said counter-plate and to cooperate with the crossbar of said U-shaped frame member, said crossbar is adapted to contain the other of said permanent magnet or said counter-plate.

7. The frame for a floor wiper of claim 6, wherein said free end of the arm of said T-shaped frame member terminates in a shoulder containing one of said permanent magnet or said counter-plate and said crossbar of said U-shaped frame member contains a groove recess adapted to cooperate with said shoulder and containing the other of said permanent magnet or said counter-plate, whereby said shoulder lies on top of said groove recess when said two frame members are in said fully extended or open position.

8. The frame for a floor wiper of claim 1, wherein the force arm distance as measured between said pivot pin and said permanent magnet and said counter-plate is sufficiently long whereby the holding action of said permanent magnet claim is sufficient to remain locked during use of said floor wiper.

9. The frame for a floor wiper of claim 8, wherein the ratio of the load arm distance as measured between said pivot pin and the far end of the U-shaped frame member to said force arm distance is about 2:1.

10. The frame for a floor wiper of claim 1, wherein in the fully extended or open position, the two frame members form a substantially flat and uninterrupted bottom surface and top surface.

11. The frame for a floor wiper of claim 1, wherein the four outer corners of said two frame members are rounded off.

12. The frame for a floor wiper of claim 1, where said two frame members are plastic.

13. The frame for a floor wiper of claim 1, wherein said two frame members comprise wire frames.

* * * * *